United States Patent [19]

Stahnke

[11] Patent Number: 5,042,353

[45] Date of Patent: Aug. 27, 1991

[54] METHOD AND APPARATUS FOR PRODUCING VARIABLE INTENSITY IN A PIANO PERFORMANCE

[76] Inventor: Wayne L. Stahnke, 11434 McCune Ave., Los Angeles, Calif. 90066

[21] Appl. No.: 573,835

[22] Filed: Aug. 23, 1990

[51] Int. Cl.[5] ..... G10F 1/02; G10F 1/00

[52] U.S. Cl. ..... 84/21

[58] Field of Search ..... 84/18, 19, 20, 21, 22, 84/23, 615, 626, 658, 681, 690

[56] References Cited

U.S. PATENT DOCUMENTS 4,132,141 1/1979 Campbell et al. ..... 84/462
4,135,428 1/1979 Campbell ..... 84/462
4,450,749 5/1984 Stahnke ..... 84/462

*Primary Examiner*—L. T. Hix
*Assistant Examiner*—Eddie C. Lee
*Attorney, Agent, or Firm*—Kelly Bauersfeld & Lowry

[57] ABSTRACT

A piano is equipped with electromechanical actuators which are individually associated with and operate the keys to reproduce a piano performance. The actuators are selectively energized according to the notes to be played to recreate a piano performance. When an actuator is energized, individual pulses of uniform width are selected from a pulse train and applied to the actuator, with the number of selected pulses varying the overall drive energy supplied to the actuator to closely approximate a desired drive or note intensity.

18 Claims, 3 Drawing Sheets

METHOD AND APPARATUS FOR PRODUCING VARIABLE INTENSITY IN A PIANO PERFORMANCE

BACKGROUND OF THE INVENTION

The present invention relates generally to improvements in playing piano music electromechanically, and more particularly to an improved method and apparatus for producing variable intensity in a piano performance to create expression effects.

It has been known for many years that a piano performance can be recreated by moving the keys and pedals mechanically. In earlier versions, a perforated paper roll was the recording medium, and actuation of the keys and pedals in response to perforations in the roll was achieved by pneumatic means. More recently, magnetic and optical recording media such as magnetic tape and/or magnetic or optical disks are used as the recording media, with solenoids or other electromagnetic devices being used as actuators for the keys and pedals.

When a performance is to be recorded, the piano is played by a musician, and sensors detect the timing and velocity with which the keys are depressed and the hammers associated with the keys are moved. This information is stored digitally on a recording medium such as magnetic tape. When the performance is to be recreated, the digital information is retrieved from the magnetic tape and converted to control signals that energize solenoid actuators to move the keys in the same order and with the same intensities as in the original performance.

To a large degree, the unique and satisfying aspects of a musical performance played on a piano are related to the intensities of the individual notes that comprise the performance. If the intensities of the individual notes are correct, the overall effect will be that of a pleasing musical whole, with each note playing its role in the larger musical structure. However, if the intensities of the individual notes are incorrect, the resulting performance will have an unmusical quality. It is due to such incorrect intensity control that performances recreated by inferior instruments are often dismissed as being "mechanical" and therefore undesirable.

Basically, in a reproducing piano, note intensity control is achieved by varying the drive applied to the key actuators. The actuators are typically large and consequently relatively slow, so that the desired drive may be approximated by rapidly alternating between full drive and no drive. The delay inherent in the actuators tends to smooth the rapidly alternating applied drive, and to a first approximation the actuators respond only to the average value of the applied drive.

In U.S Pat. No. 4,132,141, such alternating applied drive is achieved by creating a sequence of pulses of substantially fixed repetition rate, and varying the width of the pulses such that the average drive voltage specified by the pulses corresponds to the desired drive voltage. While this approach controls the drive, it suffers from several deficiencies that make it unattractive for use in a high-performance, low-cost instrument. One deficiency derives from the fact that the pulse width is modulated according to the desired drive. In order for the average drive to be controlled in this way, the height of the pulses must be uniform. Since the height of the pulses mirrors the actuator supply voltage, this supply voltage must remain constant for proper control to be achieved. A single unregulated supply is normally used for all of the actuators in the interest of economy, and its output voltage drops when many notes are played concurrently. As a result, a regulated power supply would be required to achieve the desired control, but this approach would add unnecessary cost to the instrument.

Another deficiency encountered in pulse width control schemes appears during soft play, which requires the application of a relatively low average drive voltage. The accuracy of control for soft play is compromised by the very narrow pulses that occur when low drive is required. For such very narrow pulses, the switching times constitute a significant fraction of the pulse width, resulting in unpredictable behavior.

A still further deficiency of pulse width control schemes arises from the fact that pulse width modulators are complex and therefore expensive. Ideally, there should be individual control of the drive voltage applied to each note solenoid. While this can be done with pulse-width modulation, the provision of one pulse-width modulator per note results in a system that is unnecessarily complex and expensive.

Accordingly, there has been a need for a novel method and apparatus of simplified and relatively inexpensive construction for producing variable intensity in a piano performance. Such an apparatus and method are needed which yield excellent drive control even at very low drive levels, individually control the drive to each note solenoid, and compensate for supply voltage variations. The present invention achieves these needs and provides other related advantages.

SUMMARY OF THE INVENTION

The present invention comprises a method and apparatus for controlling the intensity of the notes in a reproducing piano performance in a manner that results in a simpler and more economical mechanism than can be achieved by conventional systems presently available. More particularly, a recording of a musical performance is used in conjunction with control circuit means that includes a train of pulses of essentially uniform width. According to the recorded signal which represents the intensity of a specific note to be played, selected pulses from the pulse train are applied to a note actuator to play the note, with the number of selected pulses defining the average drive voltage supplied to the actuator, thereby controlling the intensity of the note.

In the preferred form, the intensity or loudness of the musical note is controlled by regulating the average drive voltage applied to a solenoid actuator. The solenoid actuator is situated to activate a key so that an associated hammer strikes a string of a musical instrument, such as a piano or the like. The intensity or mechanical force with which the string is struck will be proportional to the voltage level applied to the solenoid.

In accordance with the basic method of the invention, a single train of pulses of preferably uniform width is produced for use with all of the piano keys. When a particular note is to be played with a given intensity, pulses are selected from the pulse train, and the selected pulses are applied to the solenoid actuator. The specific number of selected pulses is proportional to the desired note intensity such that a summation of the selected pulses closely approximates a desired input drive energy level for driving the solenoid actuator to achieve the desired note intensity.

Pulse selection proceeds by integrating the difference between a reference drive signal and a desired drive signal representing the desired note intensity. This integrated value, referred to as the drive error variable, is examined at the onset of each pulse in the pulse train. In general terms, when the drive error variable indicates that the average drive voltage to be applied to the associated solenoid actuator is below the level required to achieve the desired note intensity, the pulse is selected. Alternately, when the drive error variable indicates that the average drive voltage exceeds the level required to achieve the desired note intensity, the pulse is not selected. In this manner, the average drive voltage required to provide a desired note intensity is closely approximated. Conveniently, the drive error variable reflects the cumulative difference between the reference drive signal and the desired drive signal, including the effect of pulse height variation, such that the selection procedure compensates automatically for variations in pulse height.

Integration may proceed continuously (at every instant in time) or discretely (once for each pulse in the pulse train). If the discrete approach is adopted, one pulse selecting circuit capable of operation at a high rate may be used repeatedly for each note played. This produces individual control of each note with a minimum of complexity.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
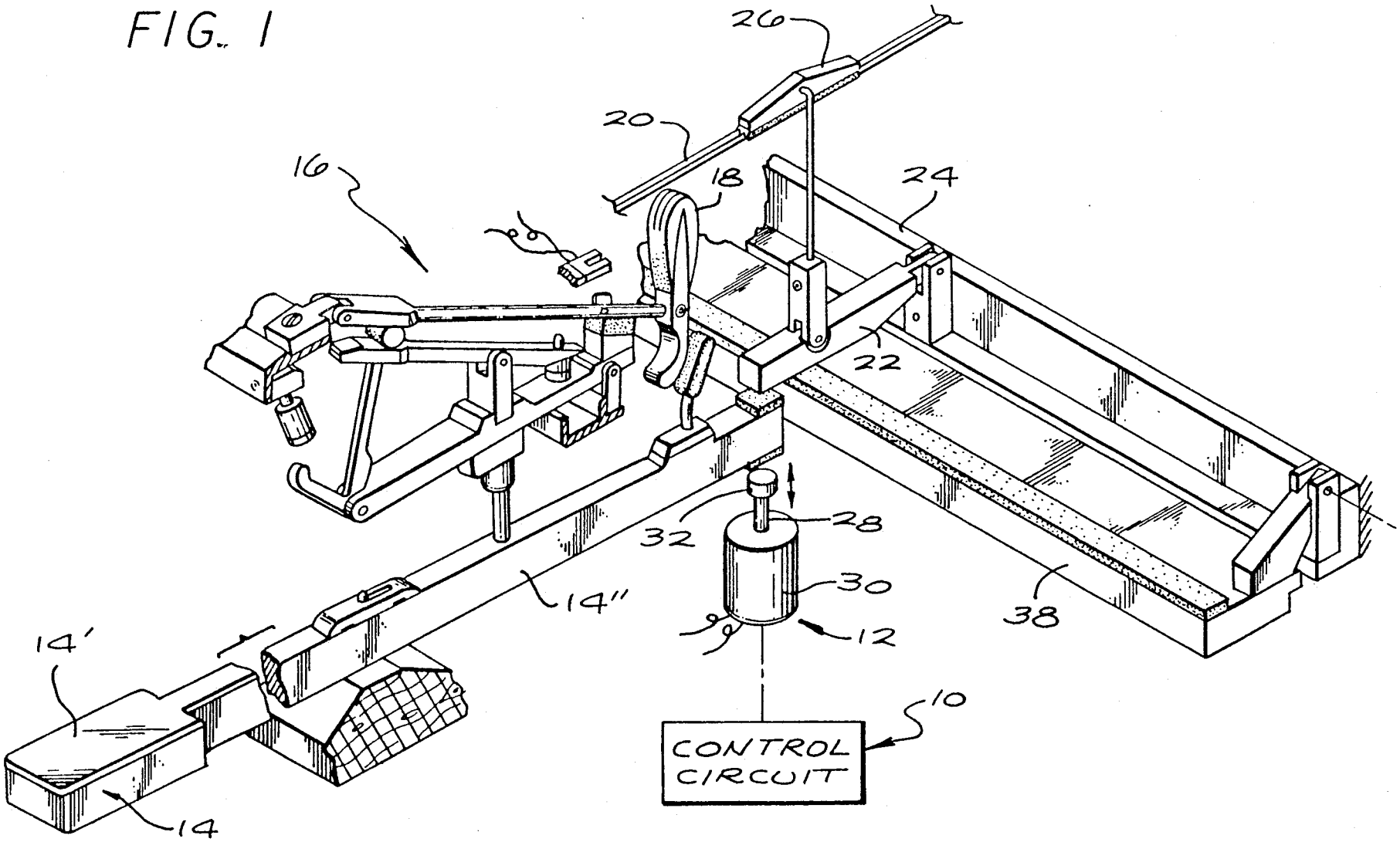
FIG. 1 is a fragmentary perspective view, schematic in nature, illustrating basic piano components in combination with electromechanical actuators and related control means in accordance with the present invention.

As shown in the drawings for purposes of illustration, the present invention relates to a method and apparatus for producing variable note intensity in a musical performance, particularly in connection with a reproducing piano. The invention comprises a control circuit referred to generally in FIGS. 1 and 2 by the reference numeral 10 for selectively energizing a plurality of note actuators 12 associated individually with a corresponding plurality of tone producing mechanisms in a musical instrument, such as the keys 14 (FIG. 1) of a piano. The control circuit 10 responds to a recording medium 13 (FIG. 2) containing a representation of a musical performance, including information representing the notes to be played and their intensities, to operate the note actuators 12 in a manner closely representing the recorded performance.

FIG. 1 illustrates the control circuit 10 in schematic relation to one of the note actuators 12 associated with one key 14 of a piano. As is known in the art, the illustrative piano key 14 is pivotally mounted for normal manual depression of an outboard end 14, thereof when it is desired to play the note associated with the key. Such depression of the key outboard end correspondingly lifts an inboard end 14'' of the key which acts through the piano action 16 to pivot a hammer 18 into striking one or more associated piano strings 20 to play the note. Concurrently with such operation of the hammer 18, the inboard end 14'' of the key 14 also engages and lifts a damper lifter 22 mounted pivotally onto the piano frame 24 to lift a string damper 26 from the strings 20 substantially immediately before the hammer 18 impacts the string or strings. The manual force used to depress the key 14 is directly proportional to the intensity or volume of the note which is played, and the duration of the note is controlled by the time span during which the key is held in a depressed position.

The note actuator 12 shown in FIG. 1 comprises a solenoid mounted onto the piano frame in a suitable manner at a position generally adjacent to the inboard end 14'' of the piano key 14. The solenoid has a conventional construction and operation to include an elongated plunger 28 which is normally returned by gravity into a solenoid housing 30, but which is thrust outwardly from the housing when the solenoid is energized. The solenoid is mounted such that a pusher tip 32 or the plunger 28 contacts and lifts the inboard end 14'' of the key 14 when the actuator is energized, thereby displacing the key in the manner required to play a note, as described above. Further description of the piano mechanism can be found in U.S Pat. No. 4,450,749 which is incorporated by reference herein.

Figure 2:
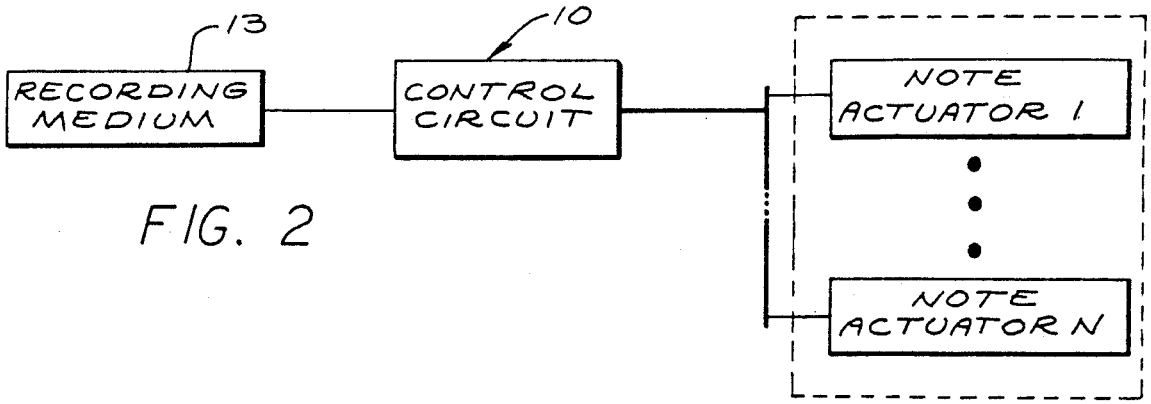
FIG. 2 is a block diagram representing the apparatus and method of this invention.

While FIG. 1 illustrates a single note actuator 12 in association with one key 14 and the related strings 20 of a piano, it will be understood that there are a plurality of note actuators 12 associated individually with multiple and preferably all of the keys of the piano. FIG. 2 shows this control circuit connection with multiple note actuators "1" through "N", said control circuit in FIG. 2 representing collectively the control circuit of FIG. 3 for each of the keys of the piano. By controlling the average drive voltage supplied to each note actuator, the control circuit can effectively operate the actuators in a manner to play a desired musical performance on the piano with individual intensity expressive effects applicable to each note when played.

Figure 3:
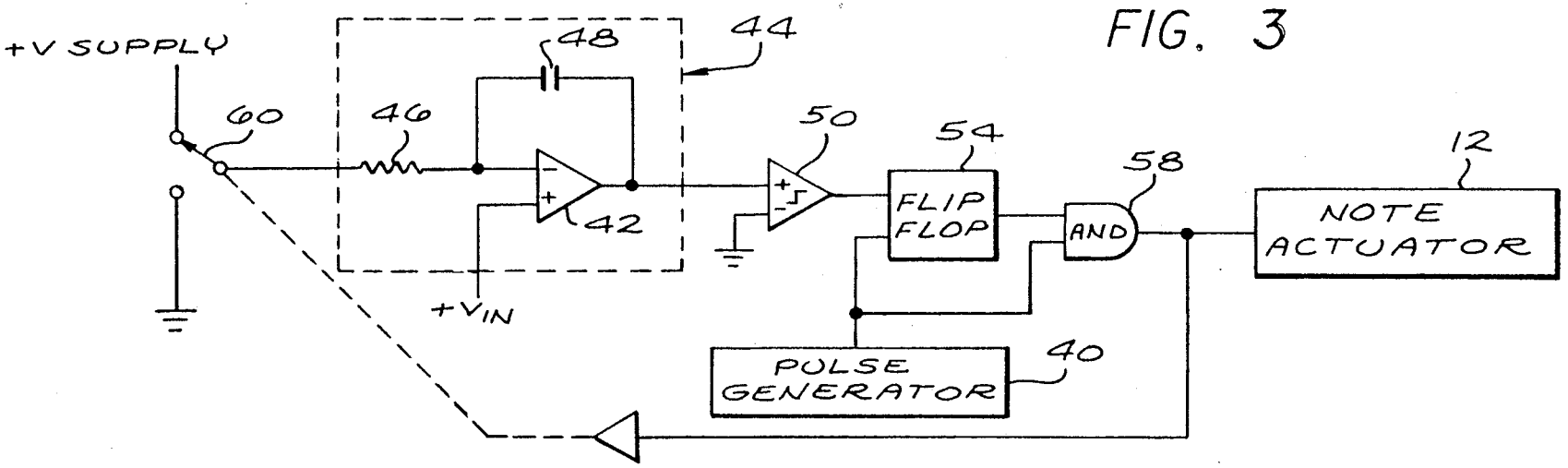
FIG. 3 is an schematic diagram of an exemplary analog control circuit for controlling actuation of a solenoid actuator associated with a particular note.
Figure 4:
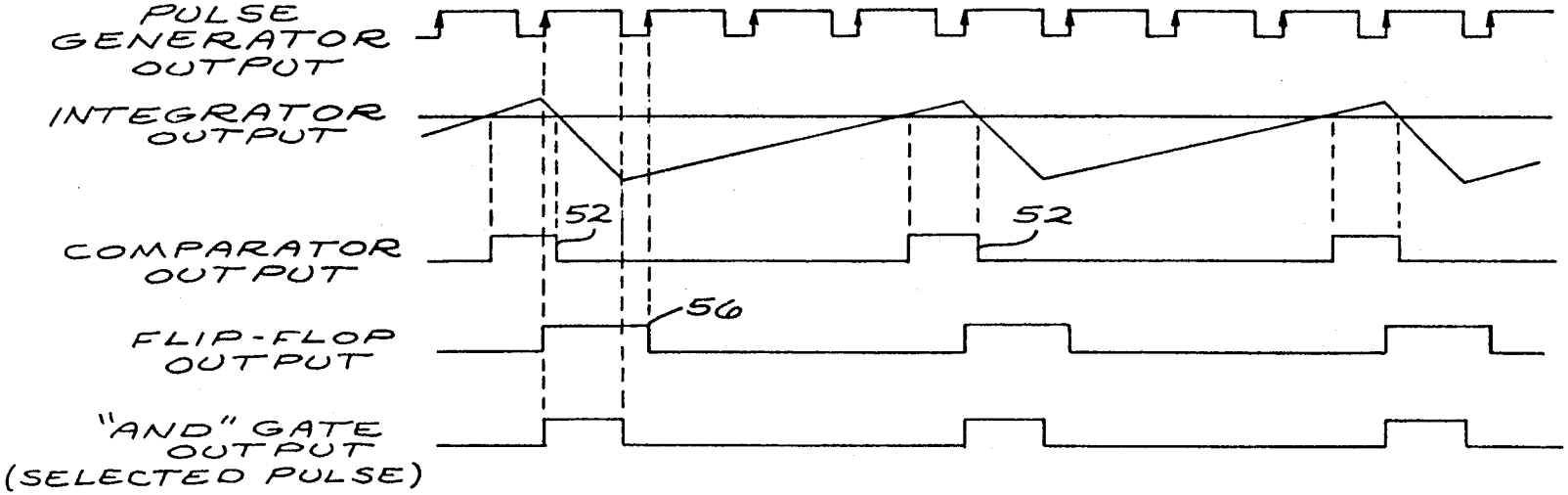
FIG. 4 is a timing diagram depicting operation of the control circuit of FIG. 3.

FIG. 3 illustrates the control circuit 10 in association with a selected one of the note actuators 12, with FIG. 4 including a schematic representation of signal waveforms used in the control scheme. More particularly, the circuit control includes a pulse generator 40 that continuously provides a pulse train output. It is generally desirable, although not necessary, for these pulses to have a uniform width. $V_{IN}$ constitutes a signal derived from the recording medium 13 (FIG. 2) and applicable to the specific note associated with the actuator 12 shown in FIG. 3, wherein the $V_{IN}$ signal represents the presence of this note and a desired intensity level for the note in the reproduction of a musical performance. In general terms, the $V_{IN}$ signal is employed by the control circuit 10 to select a number of pulses from the pulse train and to supply the selected pulses to the note actuator 12 to play the note when desired at the desired intensity level. The total number of pulses selected to play the note over a given period of time represents the average drive voltage supplied to the actuator, and thereby controls the note intensity.

The $V_{IN}$ signal is connected to an operational amplifier 42 of an integrator circuit 44, along with a ground signal or a reference signal $V_{supply}$. At any given moment, either the ground signal or the reference signal $V_{supply}$ is connected to the amplifier 42 through an electronic switch 60 and an input resistor 46. The differential amplifier 42 has associated with it a feedback capacitor 48, such that the integrator circuit 44 integrates the difference between the ground signal or the reference signal $V_{supply}$ (as the case may be) and $V_{IN}$, resulting in an output referred to herein as the "integrator output signal" or alternatively as the "drive error variable" and as illustrated in FIG. 4.

A comparator 50 compares the magnitude of the drive error variable with a reference point shown in FIG. 3 as a grounded reference. Accordingly, whenever the comparator 50 recognizes the drive error variable (i.e. the integrator output signal) to be greater than or equal to zero (the grounded reference), the output signal 52 of the comparator 50 is in the "on" state. This comparator output signal 52 continues in the "on" state until the drive error variable becomes less than zero, when it switches to the "off" state. In this regard, the integrator output signal representing the drive error variable initially has a negative value by appropriate selection of the magnitude of $V_{supply}$, and increases over time to a positive value representing a need for the drive voltage supplied to the actuator 12 to be increased in order to maintain desired note drive. The positive integrator output results in generation of the comparator output pulse 52 used to select and send one or more of the clock pulses to the note actuator.

The comparator output signal 52 is supplied to one input terminal of a flipflop 54, in parallel with the clock pulses from the pulse generator 40. When the flipflop 54 receives an indication of an "on" state from the comparator 50 coincident with a leading edge of a clock pulse, the flipflop switches to an "on" state and generates an output pulse 56 supplied to an AND gate 58. The AND gate 58 remains open for the duration of the clock pulse.

The AND gate 58 also receives the train of clock pulses from the pulse generator 40. Thus, for the duration of a single clock pulse, the AND gate passes a clock pulse to the note actuator 12. In addition, the pulse passed to the actuator is also connected to a suitable electronic switch 60 which disconnects ground from the integrator circuit 44 and reconnects the corresponding integrator terminal to $V_{supply}$ for the duration of the pulse. As a result, the output of the integrator circuit ramps in the negative direction to reset the control circuit.

In operation, the value of the drive error variable represents the drive required to operate the note actuator 12 to achieve the desired drive intensity. When the integrator output signal is positive, the average drive voltage is instantaneously below that required to drive the solenoid, and the next pulse in sequence is thus selected and supplied to the solenoid to increase the average drive voltage. The drive error variable thereupon ramps negatively to indicate that the average drive voltage momentarily exceeds the energy required to achieve the desired intensity. By appropriately selecting the clock pulse frequency, preferably on the order of 50,000 pulses per second, the average drive energy actually supplied to the note actuator, as represented by a summation of the selected pulses, represents an extremely close approximation to the actual drive energy required to achieve a particular note intensity level.

The drive error variable is thus always in flux, moving positively if its value was negative at the beginning of the current interval, or negatively if its value was positive. Thus, the average applied solenoid drive fluctuates about the desired drive, never coming to rest, and achieving the desired drive only at those instants for which the drive error variable is equal to zero. However, it is to be appreciated that the difference between the desired drive and the actual drive is small, and that moreover the average difference is zero. Thus, the method and apparatus of the present invention provides an accurate replication of an original performance in terms of note intensity level to achieve expressive effects in a reproducing piano. Moreover, by comparing the desired drive signal $V_{IN}$ with the reference signal $V_{supply}$, inherent fluctuations in power supply voltages are offset and do not impact reproduction of the piano performance.

Figure 5:
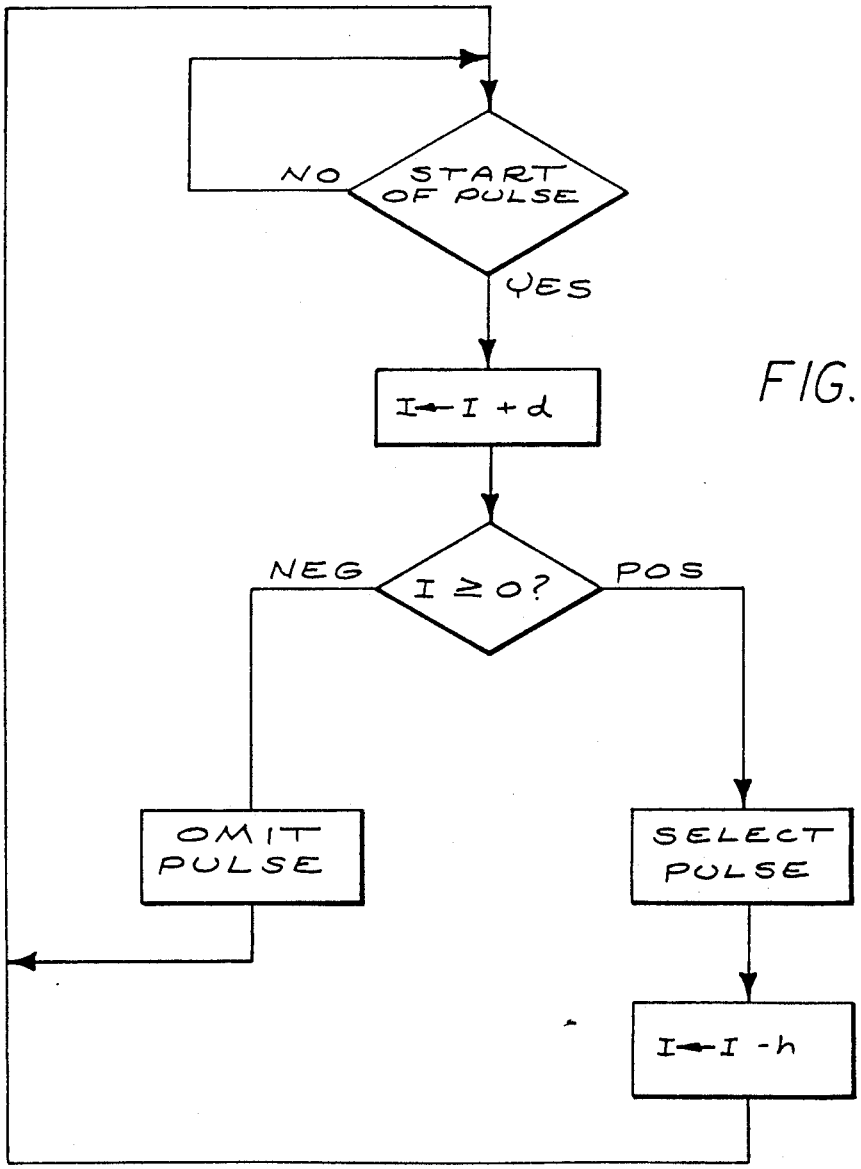
FIG. 5 is a flow diagram depicting the operation of an equivalent digital control circuit.

FIG. 5 is a flow diagram representing a digital embodiment of the control circuit as described above and shown in analog form in FIGS. 3 and 4. At the onset of each pulse, the sign of the drive error variable is examined. The current pulse is selected if the sign of the drive error variable indicates that the actual average energy has fallen below a level required to achieve the desired note intensity. Conversely, if the actual average energy exceeds the level needed to achieve desired note intensity, the pulse is omitted.

Although particular embodiments of the invention have been described in detail for purposes of illustration, various modifications may be made without departing from the spirit and scope of the invention. Accordingly, the invention is not to be limited, except as by the appended claims.

What is claimed is:

1. A method of producing variable intensity in a musical instrument operated by note actuator means, comprising the steps of:

producing a train of pulses for use in driving the note actuator means;

selecting individual pulses and omitting other individual pulses from the train of pulses, such that a summation of said selected pulses closely approximates a desired input drive energy level for driving the note actuator means to achieve a desired note intensity; and applying said selected pulses to the note actuator means;

whereby the selected pulses drive the note actuator means substantially to achieve the desired note intensity.

2. The method of claim 1 wherein the selecting step comprises generating a desired drive signal representing the desired note intensity and generating a selected reference signal, integrating the difference between said desired drive signal and said reference signal, selecting the next individual pulse in succession from said train of pulses when the integrated difference exceeds a predetermined threshold, and omitting the next individual pulse in succession from said train of pulses when the integrated difference is less than the predetermined threshold.

3. The method of claim 1 wherein the pulses are produced with substantially uniform pulse width.

4. An apparatus for operating note actuator means of a musical instrument to produce variable note intensity, comprising:

means for producing a train of pulses for use in driving the note actuator means;

means for selecting individual pulses and omitting other individual pulses from the train of pulses, such that a summation of said selected pulses closely approximates a desired input drive energy level for driving the note actuator means to achieve a desired note intensity; and means for applying the selected pulses to drive the note actuator means;

whereby the selected pulses drive the note actuator means substantially to achieve the desired note intensity.

5. The apparatus of claim 4 wherein the selecting means comprises means for generating a desired drive signal representing the desired note intensity, means for generating a selected reference signal, means for integrating the difference between the desired drive signal and the selected reference signal, and further wherein the selecting means includes means for selecting the next pulse in succession from the train of pulses when the integrated difference exceeds a predetermined threshold and for omitting the next pulse in succession from the train of pulses when the integrated difference is less then the predetermined threshold.

6. The apparatus of claim 4 wherein the pulses have a substantially uniform pulse width.

7. The apparatus of claim 4 wherein the musical instrument is a reproducing piano having a plurality of keys adapted to play individual notes, and individual note actuator means associated with the keys.

8. A method of producing variable intensity in a musical instrument operated by note actuator means, comprising the steps of:

producing a train of pulses for use in driving the note actuator means;

selecting individual pulses from the train of pulses, such that a summation of said selected pulses closely approximates a desired input drive energy level for driving the note actuator means to achieve a desired note intensity, said selecting step including omitting at least some individual pulses from the train of pulses when the desired note intensity is less than a maximum note intensity; and applying said selected pulses to the note actuator means;

whereby the selected pulses drive the note actuator means substantially to achieve the desired note intensity.

9. The method of claim 8 wherein the selecting step comprises generating a desired drive signal representing the desired note intensity and generating a selected reference signal, integrating the difference between said desired drive signal and said reference signal, selecting the next individual pulse in succession from said train of pulses when the integrated difference exceeds a a predetermined threshold, and omitting the next individual pulse in succession from said train of pulses when the integrated difference is less than the predetermined threshold.

10. The method of claim 8 wherein the pulses are produced with substantially uniform pulse width.

11. An apparatus for operating note actuator means of a musical instrument to produce variable note intensity, comprising:

means for producing a train of pulses for use in driving the note actuator means;

means for selecting individual pulses from the train of pulses, such that a summation of said selected pulses closely approximates a desired input drive energy level for driving the note actuator means to achieve a desired note intensity, said selecting means including means for omitting at least some of the pulses from the train of pulses when the desired note intensity is less than a maximum note intensity; and means for applying the selected pulses to drive the note actuator means whereby the selected pulses drive the note actuator means substantially to achieve the desired note intensity.

12. The apparatus of claim 11 wherein the selecting means comprises means for generating a desired drive signal representing the desired note intensity, means for generating a selected reference signal, means for integrating the difference between the desired drive signal and the selected reference signal, and further wherein the selecting means includes means for selecting the next pulse in succession from the train of pulses when the integrated difference exceeds a predetermined threshold and for omitting the next pulse in succession from the train of pulses when the integrated difference is less than the predetermined threshold.

13. The apparatus of claim 11 wherein the pulses have a substantially uniform pulse width.

14. The apparatus of claim 11 wherein the musical instrument is a reproducing piano having a plurality of keys adapted to play individual notes, and individual note actuator means associated with the keys.

15. A method of producing variable intensity in a musical instrument operated by note actuator means, comprising the steps of:

generating a signal for use in driving the note actuator means;

marking said signal into a succession of discrete time intervals;

selecting individual ones of said time intervals and omitting other individual ones of said time intervals such that a summation of said signal for said selected time intervals closely approximates a desired input drive energy level for driving the note actuator means to achieve a desired note intensity; and passing said signal for the duration of each of said selected time intervals to the note actuator means whereby said signal for said selected time intervals drives the note actuator means substantially to achieve the desired note intensity.

16. The method of claim 15 wherein said steps of generating the signal and marking the signal comprise generating a train of pulses.

17. An apparatus for operating note actuator means of a musical instrument to produce variable note intensity, comprising:

means for generating a signal for use in driving the note actuator means;

means for marking said signal into a succession of discrete time intervals;

means for selecting individual ones of said time intervals such that a summation of said signal for said selected time intervals closely approximates a desired input drive energy level for driving the note actuator means to achieve a desired note intensity; and means for passing said signal for the duration of each of said selected time intervals to the note actuator means whereby said signal for said selected time intervals drives the note actuator means substantially to achieve the desired note intensity.

18. The apparatus of claim 17 wherein said signal generating means and said marking means for producing a train of pulses.

* * * * *